US009709360B2

(12) United States Patent
Albertini

(10) Patent No.: US 9,709,360 B2
(45) Date of Patent: Jul. 18, 2017

(54) MARKSMANSHIP AID

(71) Applicant: Nazzareno Albertini, South Australia (AU)

(72) Inventor: Nazzareno Albertini, South Australia (AU)

( * ) Notice: Subject to any disclaimer, the term of this patent is extended or adjusted under 35 U.S.C. 154(b) by 11 days.

(21) Appl. No.: 14/972,416

(22) Filed: Dec. 17, 2015

(65) Prior Publication Data

US 2016/0178322 A1 Jun. 23, 2016

(30) Foreign Application Priority Data

Dec. 19, 2014 (AU) ..... 2014905148

(51) Int. Cl.
*F41G 1/473* (2006.01)

(52) U.S. Cl.
CPC ..... *F41G 1/473* (2013.01)

(58) Field of Classification Search
CPC . F41G 1/02; F41G 1/033; F41G 1/473; F41G 3/08
USPC ..... 42/111, 135, 136, 137, 138, 139, 141
See application file for complete search history.

(56) References Cited

U.S. PATENT DOCUMENTS 752,962 A * 2/1904 Eby ..... F41G 1/473 42/141
1,227,544 A * 5/1917 Lobdell ..... F41G 1/01 356/255
1,625,060 A * 4/1927 Storm ..... F41G 1/473 42/141
1,964,027 A * 6/1934 Bliss ..... F41G 1/46 42/141
2,056,469 A * 10/1936 King ..... F41G 1/473 42/140
2,092,356 A * 9/1937 Prather ..... F41G 1/473 42/141
2,386,420 A * 10/1945 Bailey ..... F41G 1/473 42/141
2,519,220 A * 8/1950 Bentley ..... F41G 1/473 42/141
D161,073 S * 11/1950 Williams ..... 42/137
2,613,442 A * 10/1952 Austin ..... F41G 1/18 42/139
3,434,213 A * 3/1969 Lauder ..... F41G 1/473 42/139
3,886,667 A * 6/1975 Rueb ..... F41G 1/473 42/141
4,232,449 A * 11/1980 Linenberger ..... F41G 1/54 33/275 R
4,565,009 A * 1/1986 Porter ..... F41G 1/46 33/265

(Continued)

*Primary Examiner* — Derrick Morgan
(74) *Attorney, Agent, or Firm* — Sheridan Ross P.C.

(57) ABSTRACT

The present disclosure relates to a device for aiding marksmanship and a method of use thereof. In a particular form the present disclosure relates to a device for teaching the principle of leading a target. According to one aspect, the device comprises a base securable to a firearm, a compensating sight spaced apart from the base to at least a side of the firearm and positionally adjustable with respect to the base, wherein in use, the compensating sight is so positioned with respect to the base that when the firearm is aimed at a moving target via the compensating sight an appropriate amount of lead is applied to the target.

10 Claims, 17 Drawing Sheets

(56) References Cited

U.S. PATENT DOCUMENTS

| | | | | |
|---|---|---|---|---|
| 5,924,211 | A * | 7/1999 | Wambold, Jr. | F41G 1/38 359/694 |
| 7,328,531 | B2 * | 2/2008 | Dietz | F41G 1/473 42/133 |
| 8,978,287 | B1 * | 3/2015 | Riley | F41G 1/473 42/141 |
| 9,316,464 | B2 * | 4/2016 | Frederick | F41G 11/004 |
| 2005/0086848 | A1 * | 4/2005 | Dietz | F41G 1/473 42/130 |
| 2006/0096150 | A1 * | 5/2006 | Graf | F41G 1/01 42/130 |
| 2013/0174465 | A1 * | 7/2013 | Martinez Martinez | F41G 1/033 42/139 |
| 2015/0027027 | A1 * | 1/2015 | Frederick | F41G 1/473 42/141 |
| 2015/0198414 | A1 * | 7/2015 | Raybman | F41G 1/17 42/111 |
| 2016/0102941 | A1 * | 4/2016 | Brucker | F41G 1/033 42/148 |

* cited by examiner

MARKSMANSHIP AID

CROSS-REFERENCE TO RELATED APPLICATIONS

The present application claims the benefit of Australian Provisional Patent Application No. 2014905148 entitled "A MARKMANSHIP AID" and filed on 19 Dec. 2014, the content of which is hereby incorporated by reference in its entirety.

TECHNICAL FIELD

The present disclosure relates to a device for aiding marksmanship, and a method of use thereof. In a particular form the present disclosure relates to a device for teaching the principle of leading a target.

BACKGROUND

When shooting a moving target, the shooter must, in order to hit the target, actually shoot at a distance in front of the target that will cause the shot from the firearm to intersect the trajectory of the target at the same instant that the target arrives at that point.

To hit the target the shooter must apply what is commonly known as 'lead'; lead is the distance the shooter must shoot ahead of the target to allow for the time it takes for the shot or bullet to travel from a muzzle of the firearm to the point of intersection with the trajectory at the moment that target is at that point, and thus to hit the target.

New and intermediate shooters have great difficulty estimating how much lead to give a target, as it is very difficult for them to comprehend that one must shoot so far in front of a target to hit it. This fact leads to a situation where a new or intermediate shooter can find it very difficult to hit a moving target. This provides shooters (and coaches) with a great challenge, as they struggle to give greater and greater lead to the target. This is perhaps the biggest challenge in shooting at a moving target, and is probably the biggest cause of shooter frustration.

Once a shooter is coached to be able to hit a target requiring a long lead, it is difficult for the shooter to be able to reproduce that lead. That is, they hit the target but then cannot do it with consistency. This leads to great confusion and makes it difficult for the coach to be able to keep the shooter on track.

It is against this background and the problems and difficulties associated therewith that the present disclosure has been developed.

Certain objects and advantages of the present disclosure will become apparent from the following description, taken in connection with the accompanying drawings, wherein, by way of illustration and example, an embodiment of the present disclosure is disclosed.

SUMMARY

According to a first aspect of the present disclosure, there is provided a device for aiding marksmanship, the device comprising a base securable to a firearm, a compensating sight spaced apart from the base to at least a side of the firearm and positionally adjustable with respect to the base, wherein in use, the compensating sight is so positioned with respect to the base (and thus a muzzle of the firearm in turn) that when the firearm is aimed at a moving target via the compensating sight an appropriate amount of lead is applied to the target.

The term "target" as used herein is intended to describe any moving object, living or inanimate, at which a shooter is aiming and therefore includes game and clay targets.

In one form, the base of the device is movable along, and securable with respect to, a barrel of the firearm.

In one form, the base comprises a frame comprising an aperture for receiving the barrel of the firearm there-through.

In one form, the base comprises a clamping means for locking a position of the base with respect to the firearm.

In one form, the base may be interchangeable to accommodate firearms of distinctly different types.

In one form, the compensating sight is a part of a compensating sight assembly.

In one form, the compensating sight assembly comprises an adjustment means providing a lateral (i.e. sideways) movement at least, of the compensating sight relative to the barrel of the firearm.

In one form, the adjustment means further provides a longitudinal (i.e. lengthwise along the barrel) movement of the compensating sight relative to the barrel of the firearm.

In one form, the compensating sight assembly comprises a further adjustment means providing a normal (i.e. vertical, or up and down) movement of the compensating sight relative to the barrel of the firearm.

In one form, the compensating sight assembly comprises the base, a carriage depending from the base, a wing mount depending from the carriage, a wing depending from the wing mount, and the compensating sight depending from the wing.

In one form, the base comprises a normally (relative to the barrel) extending track along which the carriage is positionable. In this way, the above mentioned 'further adjustment means' is provided.

In one form, the wing mount is pivotable with respect to the carriage, and about a longitudinal (relative to the barrel) axis.

In one form, the wing is pivotable with respect to the wing mount, and about a normal (relative to the barrel) axis. In this way, the above mentioned 'adjustment means' is provided.

In one form, the compensating sight comprises a bead. In one form, in an alternative, the compensating sight may comprise an optical or laser sight.

In one form, the device comprises a compensating sight assembly to either side of the base.

According to a second aspect of the present disclosure, there is provided a method for using the above described device to shoot a moving target, the method comprising the steps of setting a position of the compensating sight relative to the base based on characteristics of the target, and following the trajectory of the target while sighting the target via the compensating sight until the target is hit.

A detailed description of one or more embodiments of the disclosure is provided below along with accompanying figures that illustrate by way of example the principles of the disclosure. While the disclosure is described in connection with such embodiments, it should be understood that the disclosure is not limited to any embodiment. On the contrary, the scope of the disclosure is limited only by the appended claims and the disclosure encompasses numerous alternatives, modifications and equivalents. For the purpose of example, numerous specific details are set forth in the following description in order to provide a thorough understanding of the present disclosure.

The present disclosure may be practiced according to the claims without some or all of these specific details. For the purpose of clarity, technical material that is known in the technical fields related to the disclosure has not been described in detail so that the present disclosure is not unnecessarily obscured.

BRIEF DESCRIPTION OF DRAWINGS

Embodiments of the present disclosure will be discussed with reference to the accompanying drawings wherein.

In the following description, like reference characters designate like or corresponding parts throughout the figures.

DESCRIPTION OF EMBODIMENTS

Figure 1:
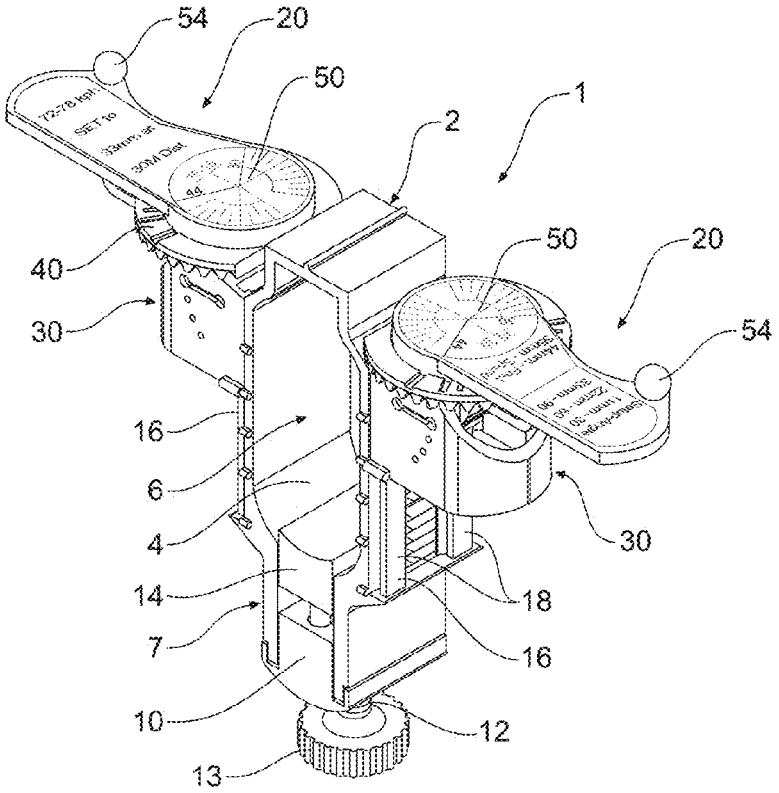
FIG. 1 is a perspective view of a device for aiding marksmanship according to a first embodiment of the present disclosure.
Figure 2:
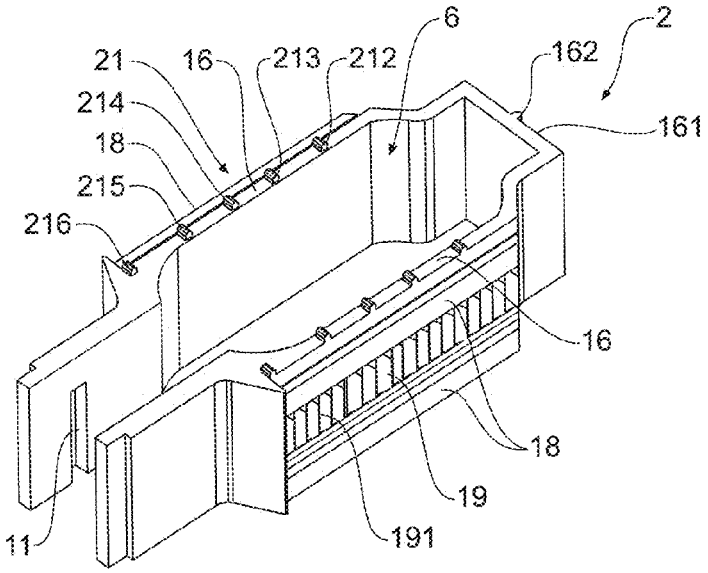
FIG. 2 is a perspective view of a base from the device of FIG. 1.
Figure 3:
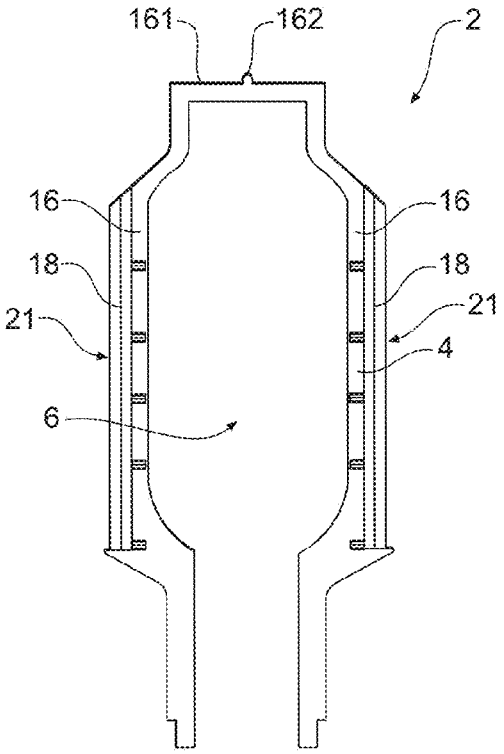
FIG. 3 is a plan view of the base of FIG. 2.
Figure 4:
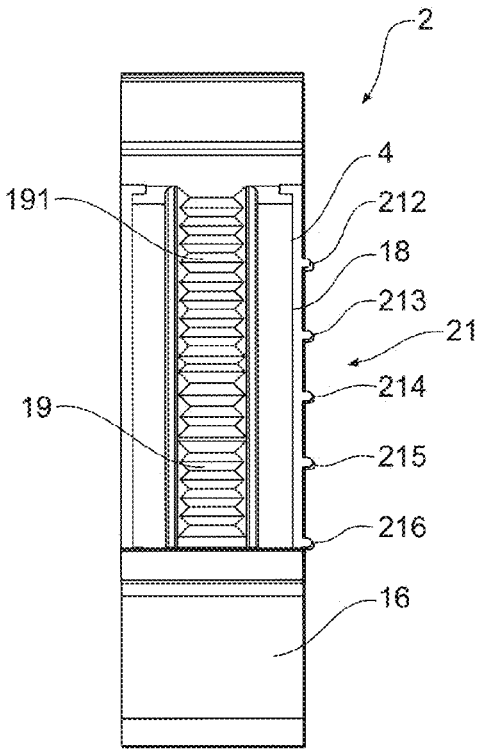
FIG. 4 is a side view of the base of FIG. 2.

Referring now to FIG. 1, there is shown a first embodiment of a device 1 for aiding marksmanship, the device comprising a base 2 which is securable to a firearm 100, by way of the base 2 comprising a frame 4 surrounding an aperture 6 for receiving a barrel 102 of the firearm 100 there-through.

The base 2 is configured for use with a barrel 102 of an over and under type shotgun 100. It should be appreciated that the device 1 could be fitted to a rifle, or configured for use with a side by side type shotgun, or any other firearm type, by use of a base shaped for fitment to that particular firearm type.

Figure 19A:
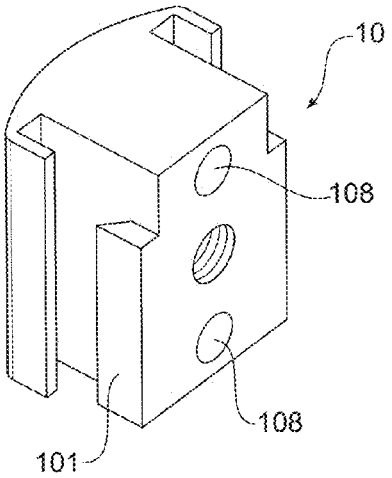
FIG. 19A is a perspective view of a clamp base from the device of FIG. 1.
Figure 19B:
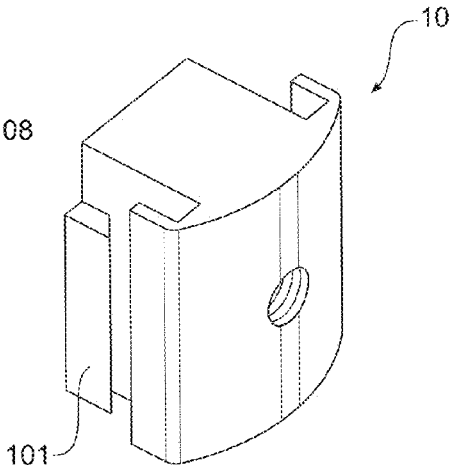
FIG. 19B is an alternative perspective view of a clamp base from the device of FIG. 1.
Figure 20:
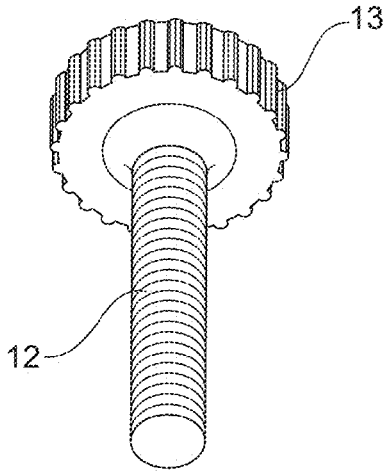
FIG. 20 is a perspective view of a clamping screw from the device of FIG. 1.
Figure 21A:
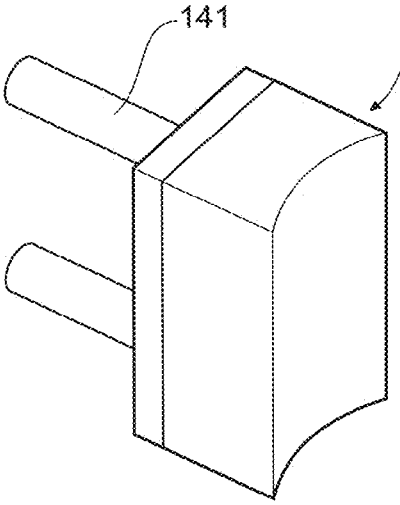
FIG. 21A is a perspective view of a movable jaw from the device of FIG. 1.
Figure 21B:
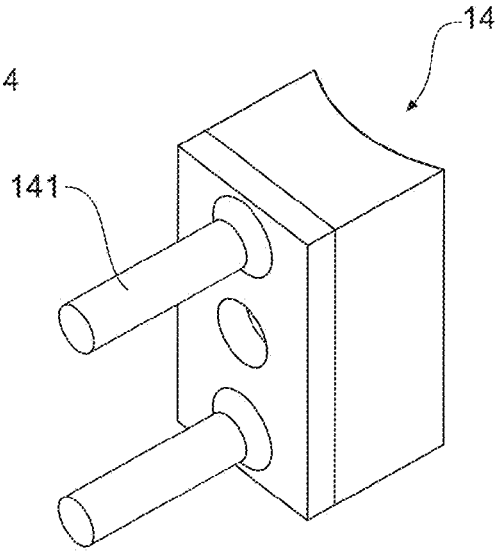
FIG. 21B is an alternative perspective view of a movable jaw from the device of FIG. 1.

With reference to FIGS. 1 through 4, it can be seen that the base 2 is an assembly comprising a clamping means 7 for clamping the device 1 to the barrel 102 of the firearm 100. This clamping means 7 comprises a clamp base 10 (see FIGS. 19A and 19B) which comprises a tooth portion 101 which slidably engages with a channel 11 in the frame 4 and is secured (by way of snap fit in this case) to the frame 4, a clamping screw 12 with a handle 13 (see FIG. 20) threaded through the clamping base 10, and a movable jaw 14 (see FIGS. 21A and 21B) secured to an end of the clamping screw 12 so as to be driven to provide clamping force to the barrel 102 with clockwise rotation of the clamping screw 12, and outwards with counter-clockwise rotation of the clamping screw 12 to release the barrel 102. Alignment pins 141 insert into guide holes 108 (shown in FIG. 19A) to guide movement of the movable jaw 14 relative to the clamping base 10.

The open U-shape of the frame 4 allows for it to be installed on the barrel 102 of the firearm 100 by sliding each side 16 over either side of the barrel 102 and then installing the clamping means 7 to clamp the device 1 to the barrel 102. The device 1 can thereby be easily attached to a barrel 102 without sliding the assembled device 1 over a front sight.

The frame 4 comprises a pair of spaced apart and parallel sides 16, a top portion 161 with a centre guide 162, wherein in use, one side 16 extends to either side of the barrel. Outwardly, each frame side 16 comprises a track 18, and a gear rack 19 extending along the track 18, along which a carriage 30 of a compensating sight assembly 20 will run, to enable what will, in use, be mainly a normal (or mainly vertical) adjustment in the position of the compensating sight assembly 20 relative to the base 2.

Each compensating sight assembly 20 comprises a carriage 30, a wing mount 40 depending from the carriage 30, a wing 50 depending from the wing mount 40, and a compensating sight 54 depending from the wing 50.

Figure 5:
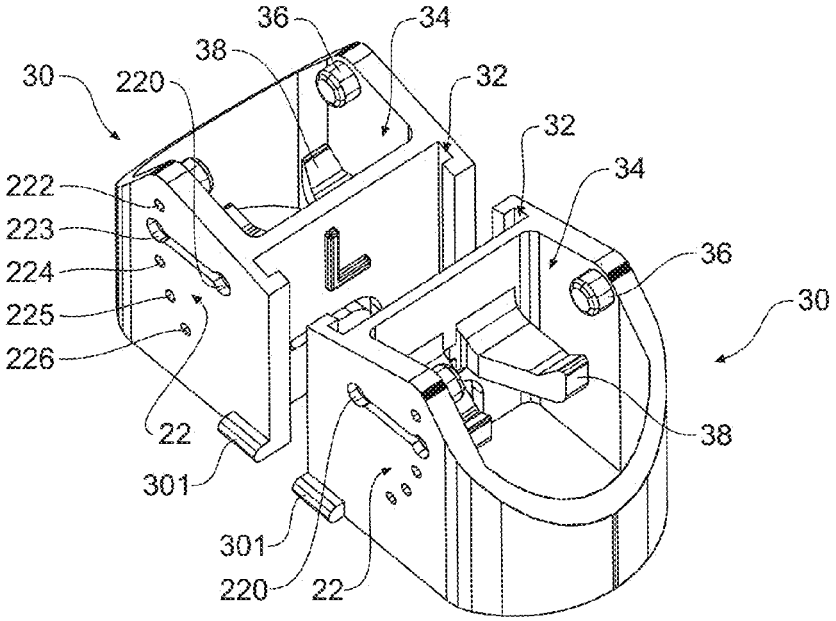
FIG. 5 is a perspective view of a pair of carriages (comprising a left hand side carriage, and a right hand side carriage) from the device of FIG. 1.
Figure 6:
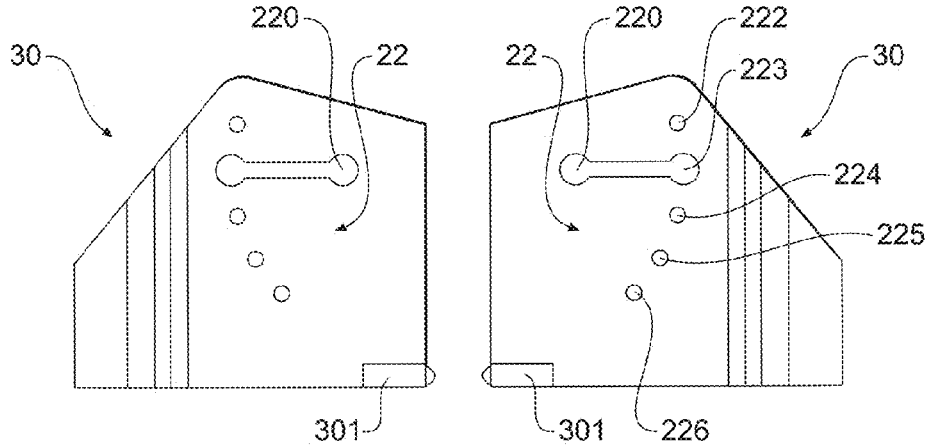
FIG. 6 is a front view of the carriages of FIG. 5.
Figure 7:
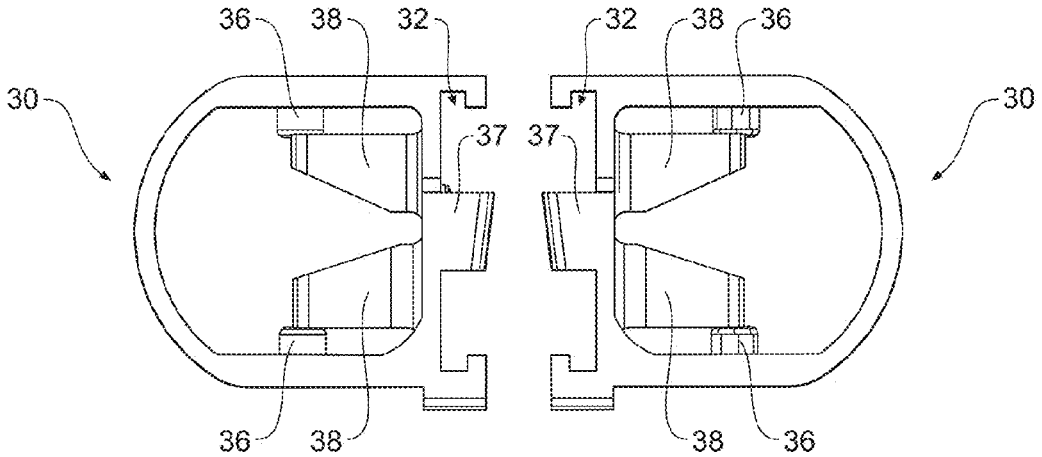
FIG. 7 is a plan view of the carriages of FIG. 6.

With reference to FIGS. 5 through 7, it can be seen that each carriage 30 comprises a body comprising a slot 32 for receiving the track 18 of the frame 4, and defining a socket 34 with two cantilever teeth 38, the purpose of which will be discussed below.

From a floor of the slot 32 there depends a cantilever tooth 37 having a tip which will run against the gear rack 19 on the frame 4, to provide a detent for mechanically resisting unintended movement of the carriage 30, and for dividing this movement into discrete increments.

The wing mount 40 (see FIGS. 8A through 12), is pivotably mounted to the carriage 30 by pivot pins 36 provided in the socket 34 of the carriage 30. The pivot pins engage with a snap fit in pivot mounts 42, for rotation about an axis parallel to a longitudinal axis of the barrel 102, so that the wing 50 may be swung up and down.

With reference to FIGS. 8A through 12, it can be seen that each wing mount 40 comprises a circular platform 44 having an upper side 442, and an underside 444, and further comprising a pair of gear segments 46 extending from the underside 444 of the platform 44 for insertion into the carriage socket 34.

Each gear segment 46 comprises a plurality of gear teeth 462 which will, in use, run against a tip of a cantilever tooth 38 which depends from the carriage 30 and is located in the socket 34, to provide a detent for mechanically resisting unintended rotation of the wing mount 40, and dividing this rotation into discrete increments. In alternative embodiments, the carriage 30 comprises a single cantilever tooth or more than one cantilever tooth.

From each wing mount 40 there depends a wing 50 (see FIGS. 13 through 18), which is generally elongate, with opposing first and second ends 511 and 512, an upper surface 513 and a lower surface 514. From the proximal underside of the wing 50 (i.e. near first end 511 on the lower surface 514) there depends a pivot pin 52 for insertion with a snap-fit in a pivot mount 48 provided in an upper side of the wing mount 40 to enable what will, in use, be a rotation of the wing 50 about a normal axis. From the distal upper side of the wing (i.e. near second end 512 on the upper surface 513) there depends the compensating sight 54 in the form of a bead (hereinafter 'the compensating bead').

From the medial underside of the wing 50 (i.e. in the lower surface 514) further depends a cantilever tooth 56 having a tip which will run against a gear rack 49 provided in the underside of platform 44 of the wing mount 40, and which extends concentrically around the pivot mount 48, to provide a detent for mechanically resisting unintended rotation of the wing 50, and dividing this rotation into discrete increments.

Figure 14A:
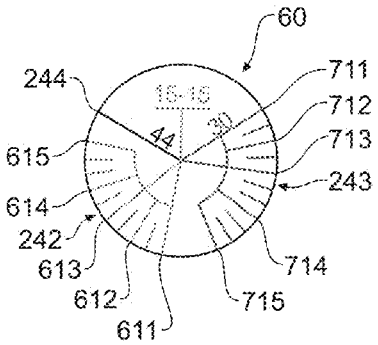
FIG. 14A is a plan view of a dial face from the wing of FIG. 13.
Figure 14B:
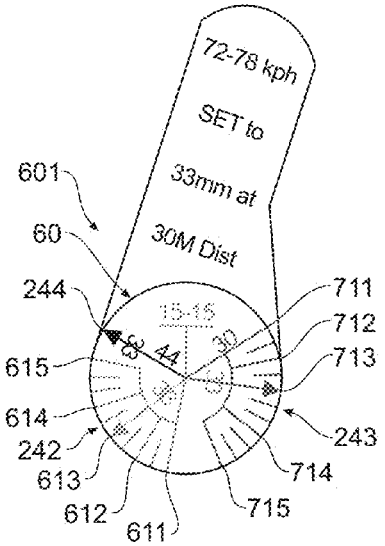
FIG. 14B is a plan view of an information panel comprising a dial face from FIG. 14A with additional information.
Figure 15:
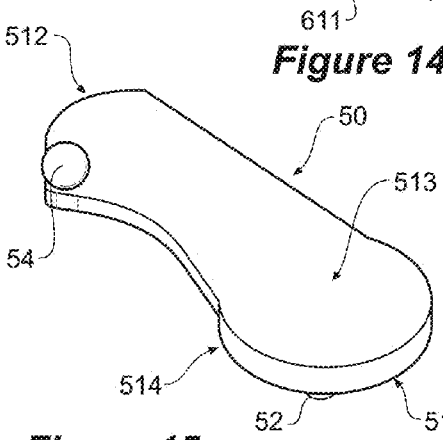
FIG. 15 is a perspective view of a right hand side wing from the device of FIG. 1.
Figure 16A:
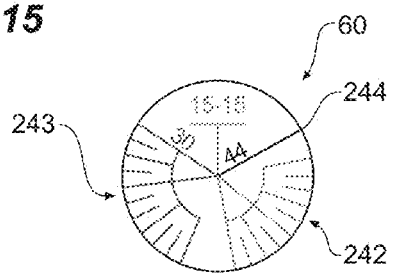
FIG. 16A is a plan view of a dial face from the wing of FIG. 15.
Figure 16B:
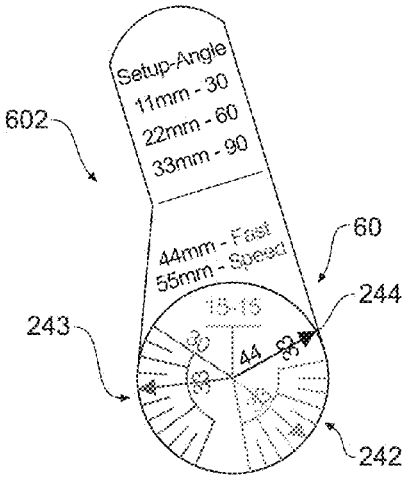
FIG. 16B is a plan view of an information panel comprising a dial face from FIG. 16A with additional information.
Figure 17:
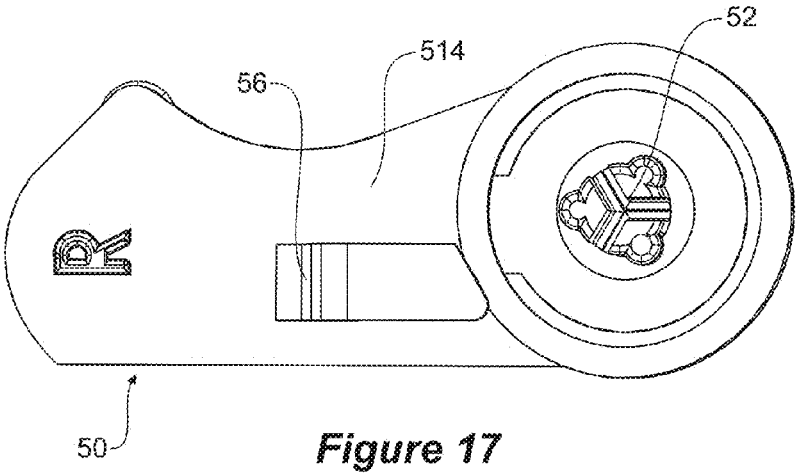
FIG. 17 is an underside view of the wing of FIG. 15.
Figure 18:
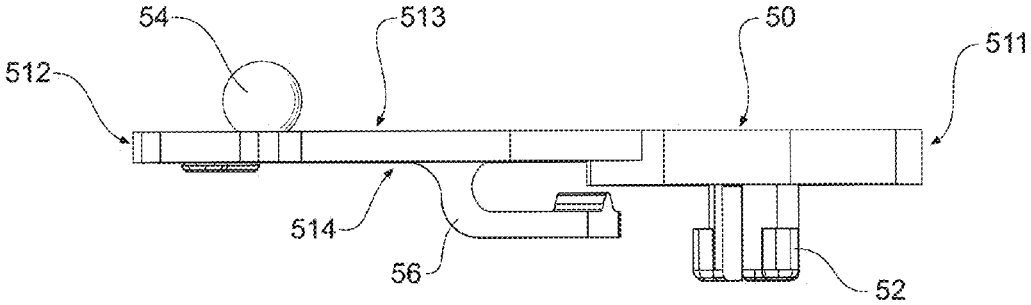
FIG. 18 is a side view of the wing of FIG. 15.
Figure 22:
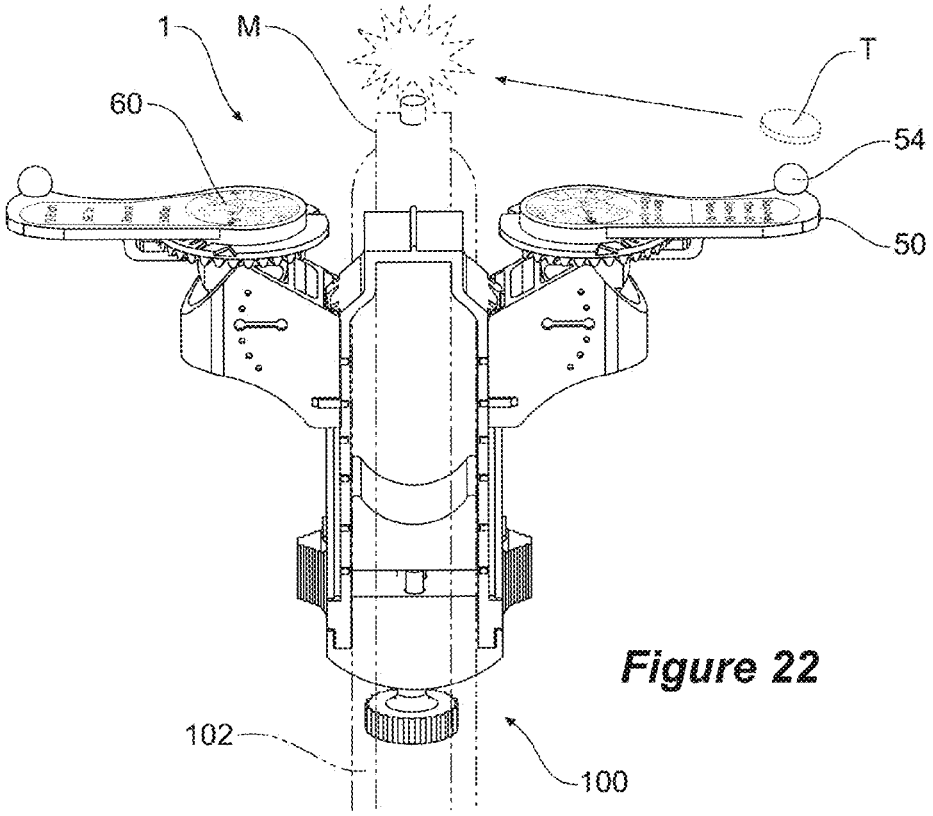
FIGS. 22 through 25 illustrate the device in use for shooting a moving target.

Carried on the proximal upper side of each wing (i.e. near first end 511 on the upper surface 513) there is an indicating dial 60 (shown in FIGS. 14A and 16A for the left and right wing, respectively), which will, in use, indicate the angle of the wing 50 relative to the wing mount 40. In some embodiments, a central axis of indicating dial 60 is substantially in line with a central axis of the pivot pin 52. FIG. 14B shows left wing information panel 601 comprising an indicating dial 60 from FIG. 14A. FIG. 16B shows right wing information panel 602 comprising an indicating dial 60 from FIG. 16A. The information panel 601 provides information about the "standard" settings for a target that is 30 meters away from the shooter and travelling at approximately 72-78 kilometers per hour (kph), where the compensating bead 54 should be 33 mm from the centre of the gun sight. The information panel 602 provides information about the settings for targets travelling at different angles relative to the shooter and for fast moving targets. In the illustrated embodiment, information is provided for targets with an approach angle of 30, 60 or 90 degrees. For example, an angle of 90 degrees indicates that the target is travelling perpendicular to the shooter (i.e. perpendicular relative to the path of the bullet with the intersection at the point of impact) as shown in FIG. 22 which is described below, whereas if the approach angle was 30 degrees (i.e. relative to the path of the bullet with the intersection at the point of impact) it would indicate that the target was approaching the shooter from behind and moving away from them as the target passed by.

Referring now to FIGS. 28 through 51B, there is shown a second embodiment of device 1 for aiding marksmanship. The device of the second embodiment is structurally and functionally similar to the device of the first embodiment, unless otherwise indicated in the description or apparent from the drawings.

Outwardly, each frame side 16 comprises a track 18, and a gear rack 19 extending along the track 18, along which a carriage 30 of a compensating sight assembly 20 will run. The device of the second embodiment differs from the first embodiment in that the gear rack 19 is of a greater length to provide greater adjustment of the carriage 30. Outwardly, each frame side 16 comprises a stud 9, which may provide a stop to the movement of the carriage 30 along the track 18.

Alignment pins 141 on moveable jaw 14 (shown in FIGS. 51A and 51B) insert into guide holes 108 in clamping base 10 (shown in FIG. 49A) to guide movement of the movable jaw 14 relative to the clamping base 10.

Carried on the proximal upper side of the left wing is information panel 6010 and on the right wing is information panel 6020 (shown in FIGS. 43 and 48, respectively), each information panel comprises an indicating dial 60 (shown in FIG. 44 for the left wing only), which will, in use, indicate the angle of the wing 50 relative to the wing mount 40. The information panel 6010 provides similar information to information panel 601 about the "standard" settings for a target that is 30 meters away from the shooter and travelling at approximately 72-78 kilometers per hour (kph), with the difference being that compensating bead 54 should be 36 mm from the centre of the gun sight. The information panel 6020 provides similar information to information panel 602 about the settings for targets travelling at different angles relative to the shooter or for fast moving targets, with the differences being the listed distances that the compensating bead will be from the centre of the gun sight for a given target. These differences in the distance of the compensating bead from the centre of the gun sight between the first and second embodiments are detailed further below.

The slidable movement of the carriage 30 relative to the frame 4, the pivotable movement of the wing mount 40 relative to the carriage 30 and the pivotable movement of the wing 50 relative to the wing mount 40 allow the shooter to adjust the lead to account for variables such as the distance from the target, the speed of the target and the trajectory of the target. To assist with setting the device 1 to account for a target, the frame 4 comprises markings 21 on each side 16 as a reference for the position of the carriage 30, each carriage 30 comprises markings 22 as a reference for the angle of the wing mount 40 and wing 50, and finally each wing mount 40 comprises pointers 232 and 233 and a quadrant of graduations 234 which align with a quadrant of graduations 242 and 243 and pointer 244, respectively, as a reference for the distance of the compensating bead 54 from the centre of the gun sight.

The markings 21 on the frame 4 provide guidance as to the appropriate adjustment of the carriage 30 relative to the frame 4 for a target with a 15 degree fall 212, a level target 213, a 15 degree rise 214, a 30 degree rise 215 and a 44 degree rise 216. The frame 4 of the second embodiment also comprises marking 211 to provide adjustment for a target with a 30 degree fall. In alternative embodiments, the frame 4 provides adjustment for targets with greater degrees of either one or both of rise and fall. The gear rack 19 comprises gears 191 which provide for fine adjustment between the markings 21. The markings 22 on the carriage 30 provide guidance as to the appropriate adjustment of the wing mount 40 relative to the carriage 30 for a target with a 15 degree fall 222, a level target 223, a 15 degree rise 224, a 30 degree rise 225 and a 44 degree rise 226. The carriage 30 of the second embodiment also comprises marking 221 to provide adjustment for a target with a 30 degree fall. In alternative embodiments, the carriage provides adjustment for targets with greater degrees of either one or both of rise and fall. In other non-illustrated embodiments, the markings 22 are through holes and an indicator on the wing mount 40 is visible through the appropriate hole according to the adjustment of the wing mount, for example, through hole 222 appears coloured or illuminated when selected.

The pointers and graduations on each indicating dial 60 and on each wing mount 40 indicate the distance of the compensating bead 54 from the centre of the gun sight. The graduations are in degrees and indicate the distance in millimeters (mm). Due to the structural differences between the first embodiment shown in FIGS. 1 to 21B and the second embodiment shown in FIGS. 28 to 51B, the distance of the compensating bead 54 from the centre of the gun sight will be different in order to provide the appropriate lead for the same target. However, the similarities between the pointers and graduations mean that in use the first and second embodiments are functionally equivalent and corresponding reference characters will be used. For 30 or 15 degree falling target, a level target or a 15 degree rising target, a pointer 232 on the wing mount aligns within a quadrant of graduations 242 on the indicating dial 60. For the first embodiment, alignment of the pointer 232 with the graduation 611 places the compensating bead 11 mm from the centre of the gun sight and the other graduations have the following meaning: 612 (22 mm), 613 (33 mm), 614 (44 mm), 615 (55 mm). For the second embodiment, alignment of the pointer 232 with the graduation 611 places the compensating bead 12 mm from the centre of the gun sight and the other graduations have the following meaning: 612 (24 mm), 613 (36 mm), 614 (48 mm), 615 (60 mm). Use of graduation 613 may be particularly suitable for a target that is 30 meters away from the shooter and travelling at approximately 72-78 kilometers per hour (kph). Adjustments can be made to the device to account for variations in the distance of the target from the shooter and for targets travelling at different speeds or different angles relative to the shooter, as appropriate. The wing may also be adjusted relative to the wing mount at finer increments than indicated by graduations 611, 612, 613, 614 and 615 (or any other graduations), which is provided by cantilever tooth 56 running against gear rack 49. In alternative embodiments, the wing provides adjustment for placing the compensating bead greater than 55 mm for the first embodiment or 60 mm for the second embodiment from the centre of the gun sight to account for a fast moving target.

For the first embodiment, for a 30 degree rising target, the pointer 233 on the wing mount aligns within the quadrant of graduations 243 on the indicating dial 60 and the graduations have the following meaning: 711 (11 mm), 712 (22 mm), 713 (33 mm), 714 (44 mm), 715 (55 mm). For the second embodiment, for a 30 degree rising target, the pointer 233 on the wing mount aligns within the quadrant of graduations 243 on the indicating dial 60 and the graduations have the following meaning: 711 (12 mm), 712 (24 mm), 713 (36 mm), 714 (48 mm), 715 (60 mm).

For the first embodiment, for a 44 degree rising target, the pointer 244 on the indicating dial 60 aligns within the quadrant of graduations 234 on the wing mount and the graduations have the following meaning: 811 (11 mm), 812 (22 mm), 813 (33 mm), 814 (44 mm), 815 (55 mm). For the second embodiment, for a 44 degree rising target, the pointer 244 on the indicating dial 60 aligns within the quadrant of graduations 234 on the wing mount and the graduations have the following meaning: 811 (12 mm), 812 (24 mm), 813 (36 mm), 814 (48 mm), 815 (60 mm).

Figure 8A:
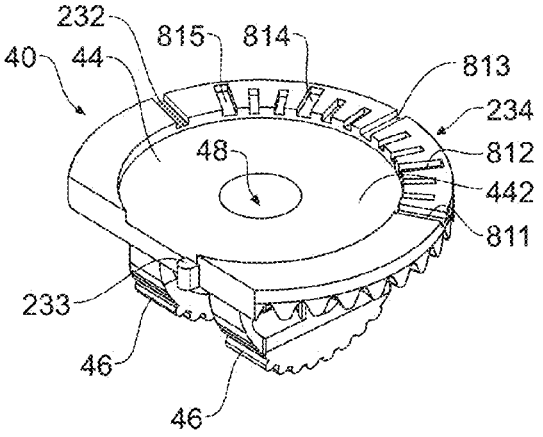
FIG. 8A is a perspective view of a left hand side wing mount from the device of FIG. 1.
Figure 8B:
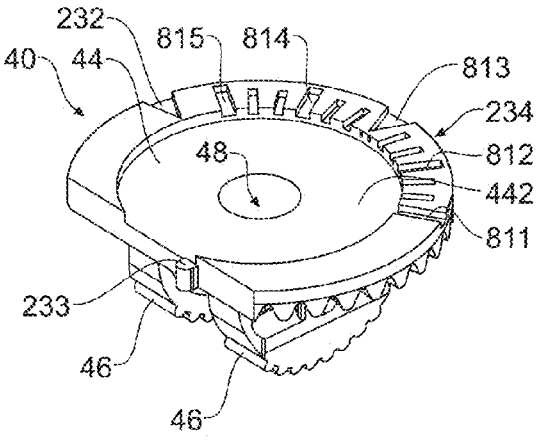
FIG. 8B is a perspective view of an alternative embodiment of a left hand side wing mount from the device of FIG. 1.
Figure 9A:
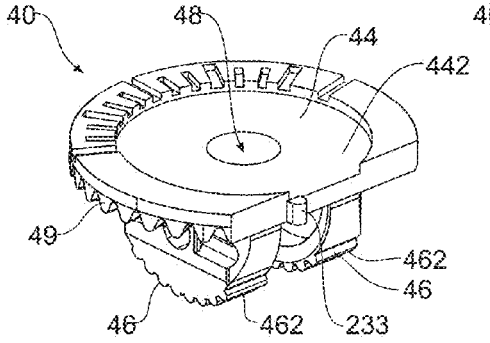
FIG. 9A is a perspective view of a right hand side wing mount from the device of FIG. 1.
Figure 9B:
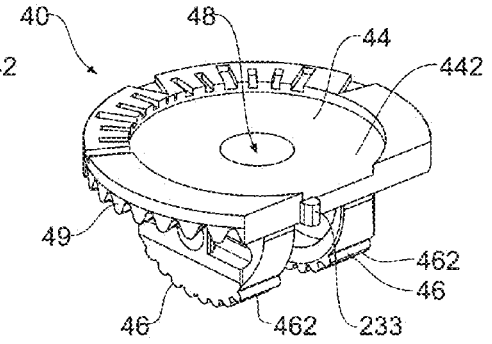
FIG. 9B is a perspective view of an alternative embodiment of a right hand side wing mount from the device of FIG. 1.
Figure 10:
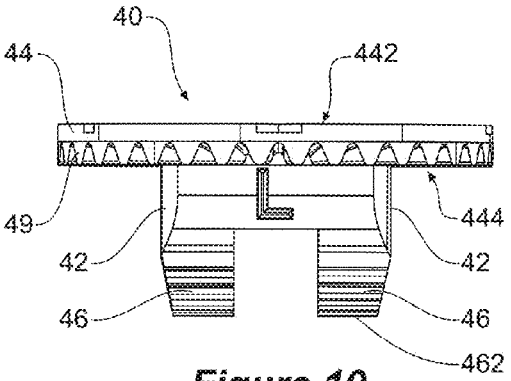
FIG. 10 is an end view of the left hand side wing mount of FIG. 9.
Figure 11:
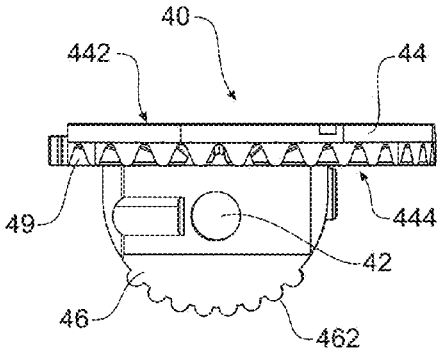
FIG. 11 is a side view of the left hand side wing mount of FIG. 8.
Figure 12:
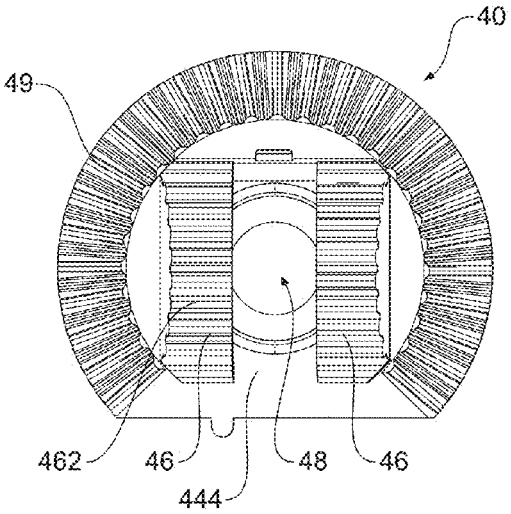
FIG. 12 is an underside view of the right hand side wing mount of FIG. 9.
Figure 13:
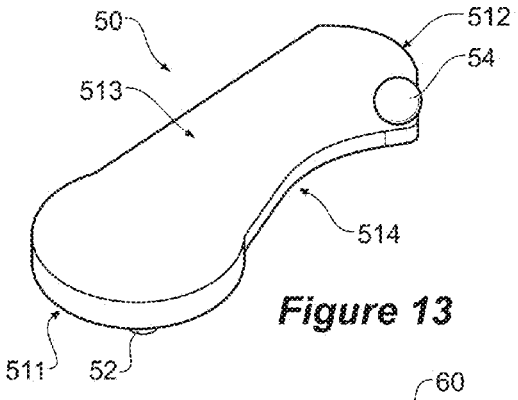
FIG. 13 is a perspective view of a left hand side wing from the device of FIG. 1.
Figure 35:
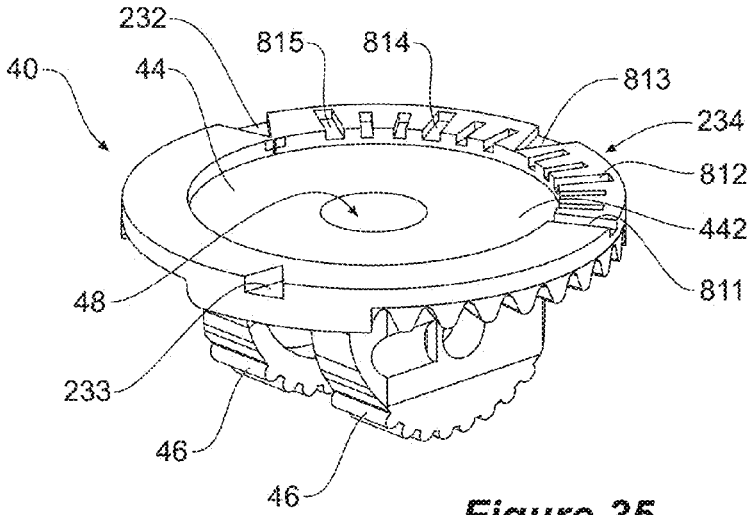
FIG. 35 is a perspective view of a left hand side wing mount from the device of FIG. 28.
Figure 36:
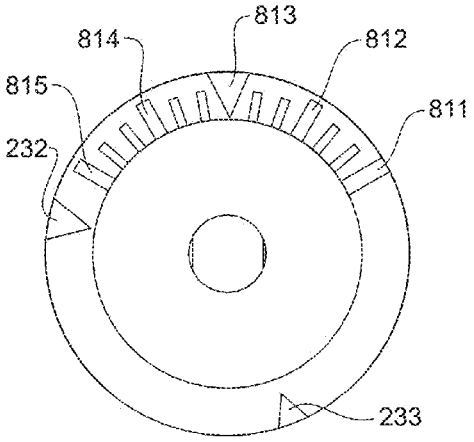
FIG. 36 is a plan view of the left hand side wing mount of FIG. 35.
Figure 37:
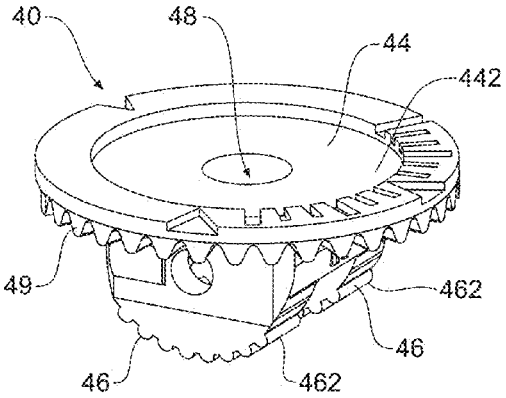
FIG. 37 is a perspective view of a right hand side wing mount from the device of FIG. 28.
Figure 38:
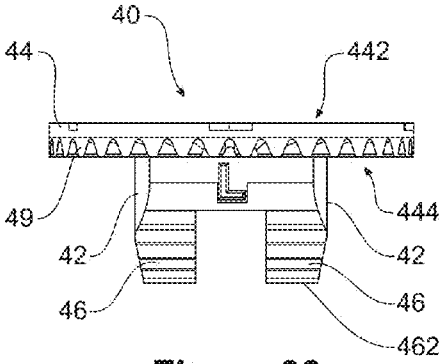
FIG. 38 is an end view of the left hand side wing mount of FIG. 35.
Figure 39:
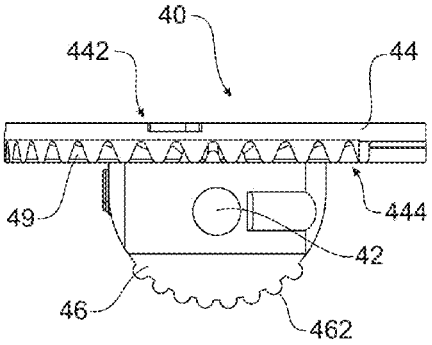
FIG. 39 is a side view of the left hand side wing mount of FIG. 35.
Figure 40:
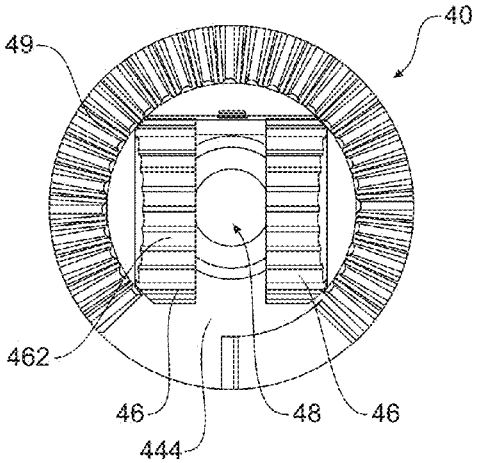
FIG. 40 is an underside view of the left hand side wing mount of FIG. 35.
Figure 41:
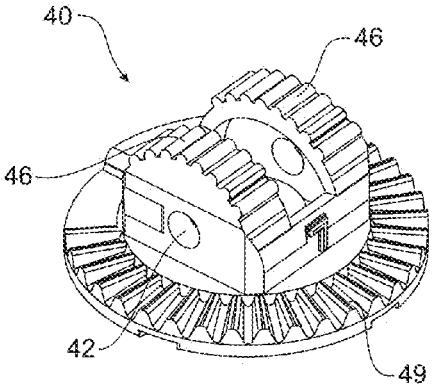
FIG. 41 is a perspective underside view of a left hand side wing mount of FIG. 35.
Figure 42:
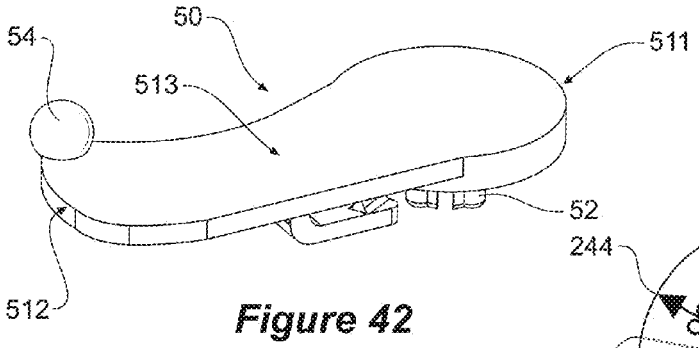
FIG. 42 is a perspective view of a left hand side wing from the device of FIG. 28.
Figure 44:
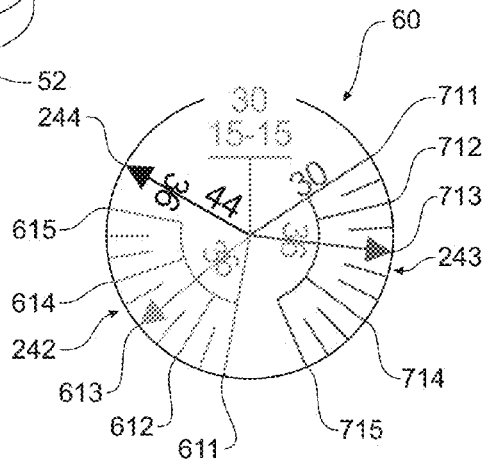
FIG. 44 is a plan view of a dial face from the information panel of FIG. 43.
Figure 43:
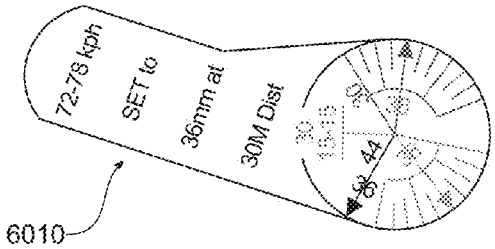
FIG. 43 is a plan view of an information panel from the wing of FIG. 42.
Figure 45:
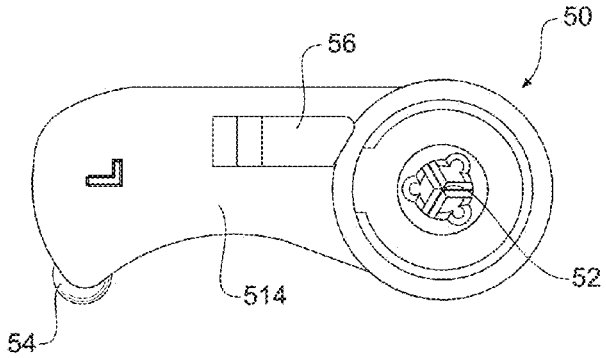
FIG. 45 is an underside view of the wing of FIG. 42.
Figure 46:
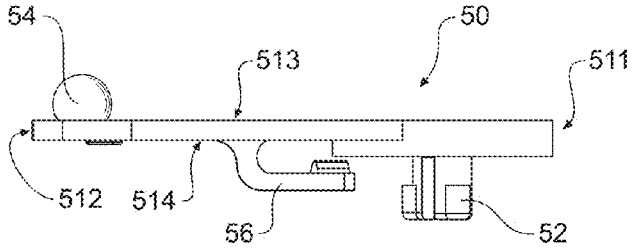
FIG. 46 is a side view of the wing of FIG. 42.
Figure 47:
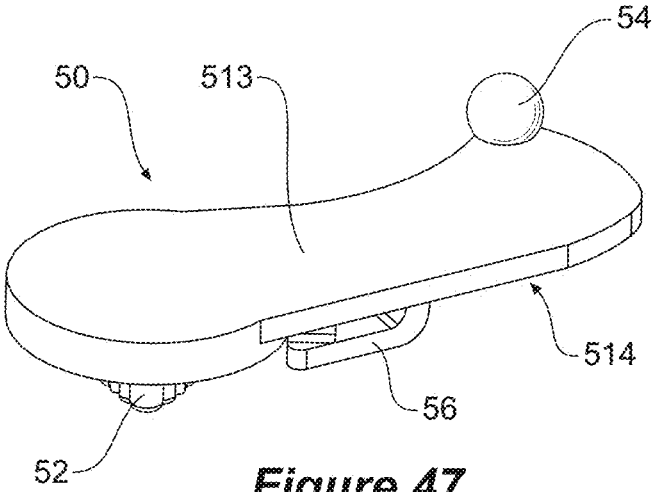
FIG. 47 is a perspective view of a right hand side wing from the device of FIG. 28.
Figure 48:
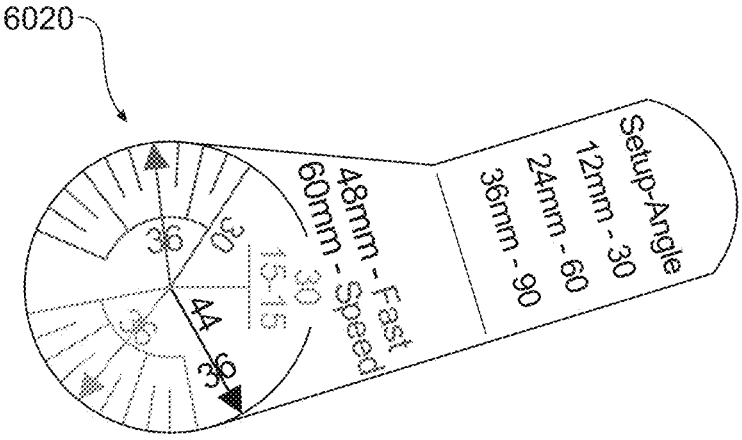
FIG. 48 is a plan view of an information panel from the wing of FIG. 47.
Figure 49A:
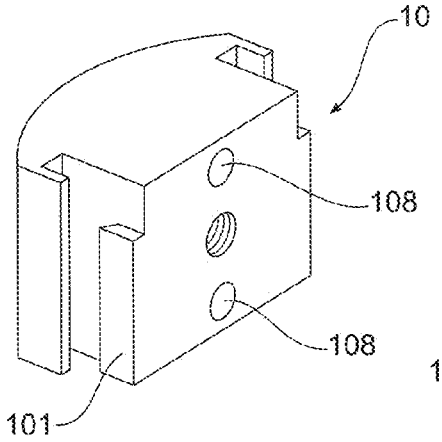
FIG. 49A is a perspective view of a clamp base from the device of FIG. 28.
Figure 49B:
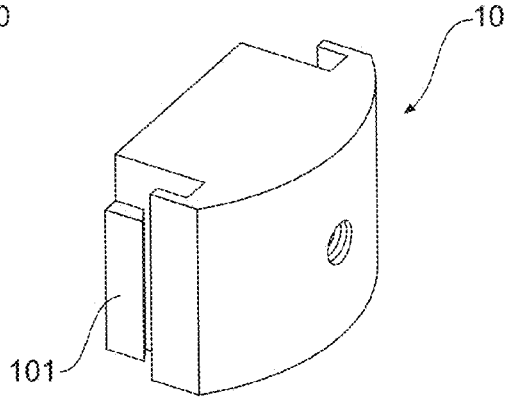
FIG. 49B is an alternative perspective view of a clamp base from the device of FIG. 28.
Figure 50:
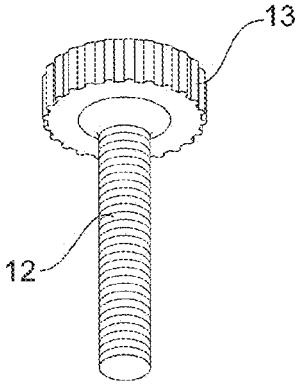
FIG. 50 is a perspective view of a clamping screw from the device of FIG. 28.
Figure 51A:
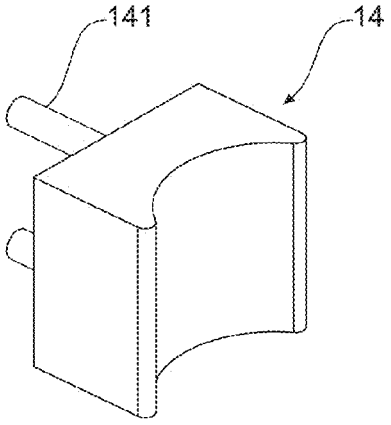
FIG. 51A is a perspective view of a movable jaw from the device of FIG. 28.
Figure 51B:
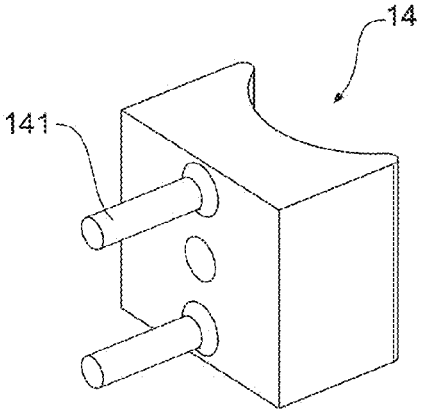
FIG. 51B is an alternative perspective view of a movable jaw from the device of FIG. 28.

The pointers 232, 233, 244 and graduation 813 may be any suitable shape that indicates the position of the wing relative to the wing mount, for example, triangular, as shown in FIGS. 35 to 37 or rectangular, as shown in FIGS. 8A and 9A.

In use, each of the carriage 30, the wing mount 40 and the wing 50 are adjusted together to account for the distance, speed and trajectory of the target. The markings may be colour coded, where a colour indicates which settings are appropriate for the particular target. For example, each of markings 212, 222, pointer 232 and quadrant of graduations 242 may be the colour red. When in use, for a 15 degree falling target, the carriage 30 is set (i.e. slid) to align indicator 301 with marking 212 on the frame 4, the wing mount is set (i.e. tilted) in line with an imaginary line drawn between marking 220 and marking 222 on the carriage 30, and the wing 50 is adjusted (i.e. rotated) so that the pointer 232 on the wing mount aligns within the quadrant of graduations 242 on the indicating dial 60. The wing 50 may then be rotated relative to the wing mount 40 to align the pointer 232 to the appropriate graduation within the quadrant of graduations 242 according to the nature of the target. For example, for a target with an approach angle of 30 degrees, the pointer 232 aligns with graduation 611 which places the compensating bead 12 mm from the centre of the gun sight. For a target with greater approach angle (i.e. 60 or 90 degrees) or a faster moving target, the wing would be pivoted to place the compensating bead 54 further from the centre of the gun sight.

For a level target, markings 213 and 223 are selected and the wing 50 is adjusted so that the pointer 232 on the wing mount aligns within the quadrant of graduations 242 on the indicating dial 60. The wing 50 may then be rotated relative to the wing mount 40 to align the pointer 232 to the appropriate graduation within the quadrant of graduations 242 according to the nature of the target.

For a 15 degree rising target, markings 214 and 224 are selected and the wing 50 is adjusted so that the pointer 232 on the wing mount aligns within the quadrant of graduations 242 on the indicating dial 60. The wing 50 may then be rotated relative to the wing mount 40 to align the pointer 232 to the appropriate graduation within the quadrant of graduations 242 according to the nature of the target.

For a 30 degree rising target, markings 215 and 225 are selected and the wing 50 is adjusted so that the pointer 233 on the wing mount aligns within the quadrant of graduations 243 on the indicating dial 60. The wing 50 may then be rotated relative to the wing mount 40 to align the pointer 233 to the appropriate graduation within the quadrant of graduations 243 according to the nature of the target.

For a 44 degree rising target, markings 216 and 226 are selected and the wing 50 is adjusted so that the pointer 244 on the indicating dial 60 aligns within the quadrant of graduations 234 on the wing mount. The wing 50 may then be rotated relative to the wing mount 50 to align the pointer 244 to the appropriate graduation within the quadrant of graduations 234 according to the nature of the target.

Using the device of the second embodiment, for a 30 degree falling target, markings 211 and 221 are selected and the wing 50 is adjusted so that the pointer 232 on the wing mount aligns within the quadrant of graduations 242 on the indicating dial 60. The wing 50 may then be rotated relative to the wing mount 40 to align the pointer 232 to the appropriate graduation within the quadrant of graduations 242 according to the nature of the target.

Referring now to FIG. 22, where, in use, the device 1 fits over the end of the barrel 102 of a firearm 100, and is secured in a position close to a muzzle M using the clamping means. The wings 50 on each side of the barrel(s) 102 allow the shooter or the coach to establish the correct lead at any given distance/target speed combination by creating a 'sight picture' that shows the shooter the correct amount and type of lead (i.e. how far in front and how far above or below the target the muzzle M of the firearm 100 must be when the shooter pulls the trigger—and of course follows through).

The adjustability of each compensating sight assembly 20 means the shooter or coach can 'set the lead', by setting the position of the compensating bead 54. That is, provide a visual cue as to the amount and type of lead that the shooter needs to apply to place his or her shot so it intersects the trajectory of the particular target T. For example, the coach can instruct the shooter and provide a cue to shoot "to the left of a target" as shown in FIG. 22.

Figure 26:
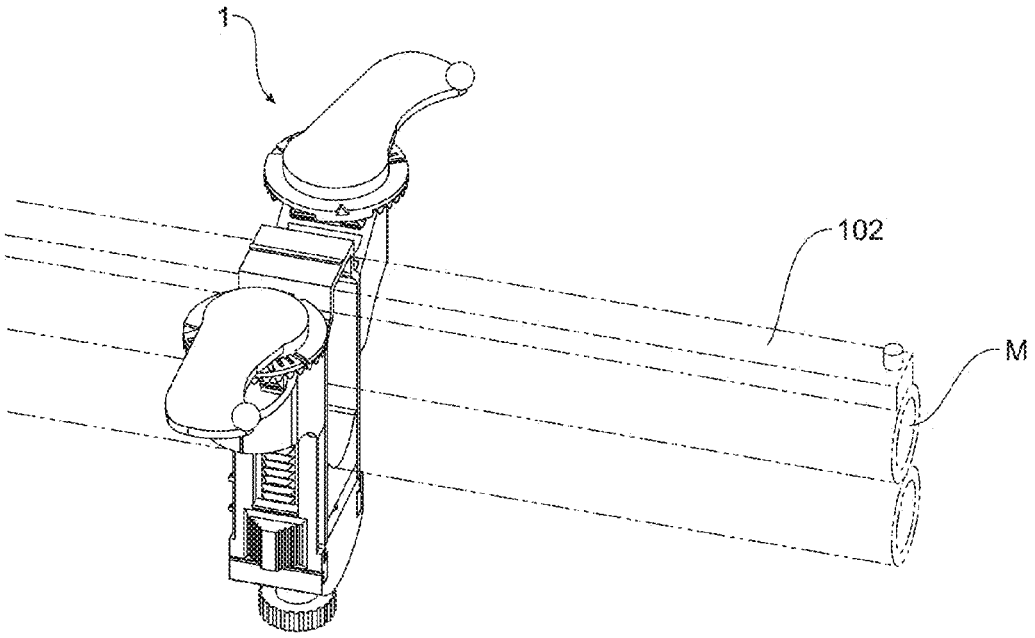
FIGS. 26 and 27 illustrate the device in different positions along the barrel.
Figure 27:
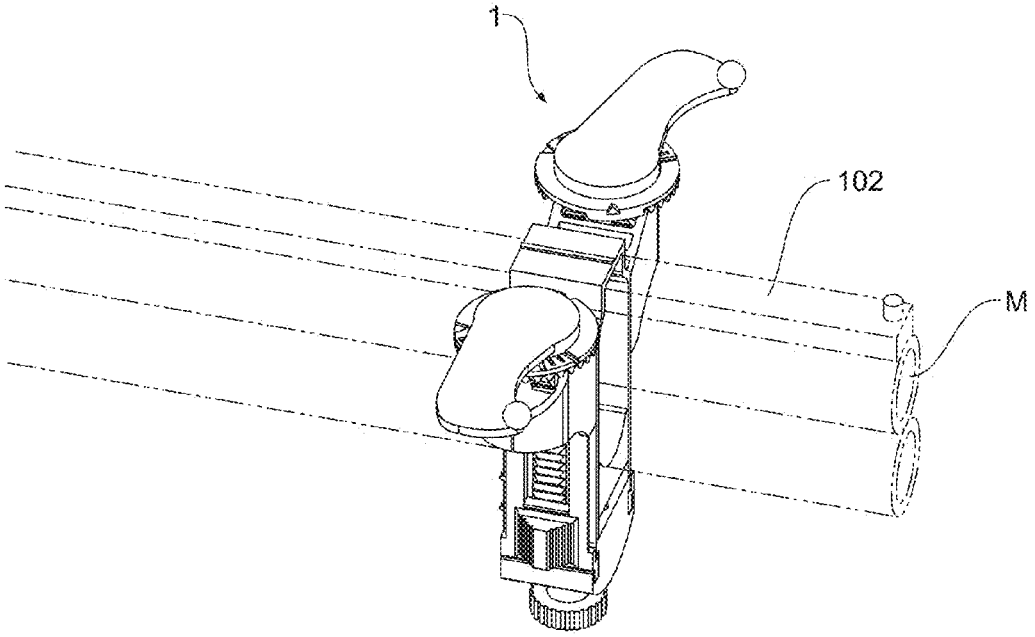
Figure 28:
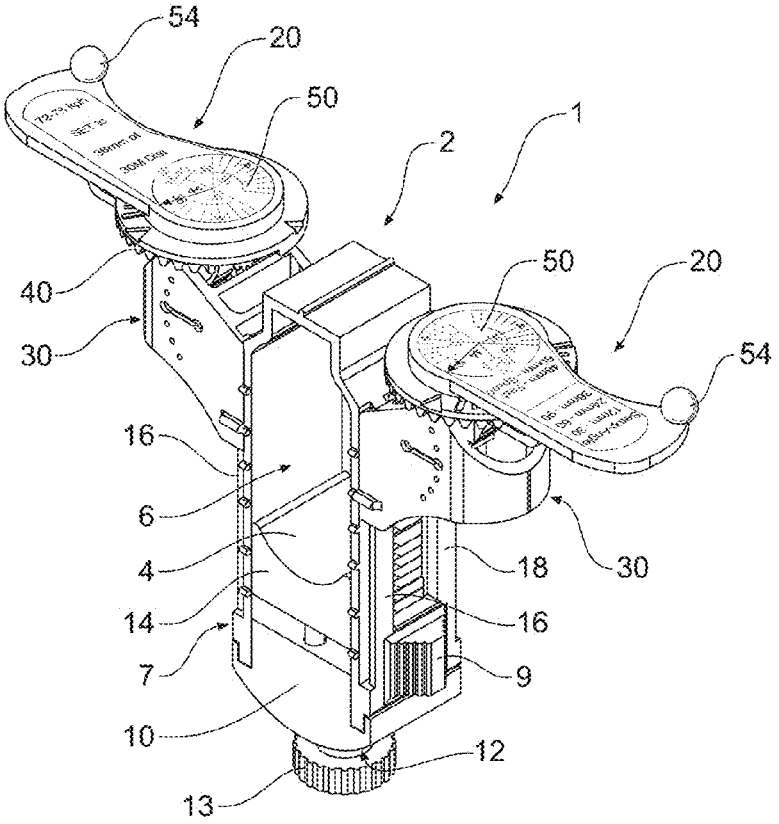
FIG. 28 is a perspective view of a device for aiding marksmanship according to a second embodiment of the present disclosure.
Figure 29:
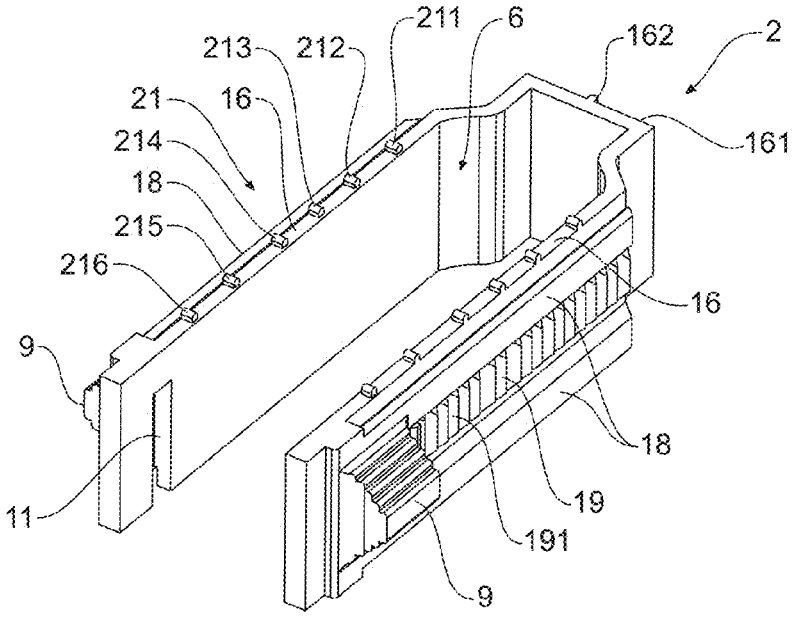
FIG. 29 is a perspective view of a base from the device of FIG. 28.
Figure 30:
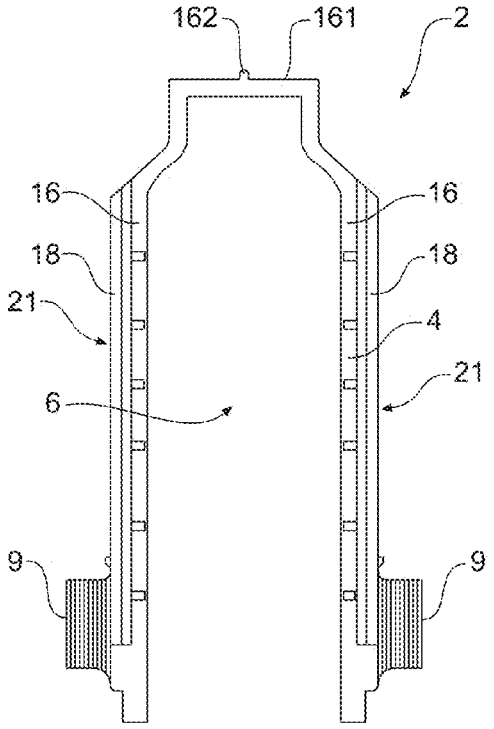
FIG. 30 is a plan view of the base of FIG. 29.
Figure 31:
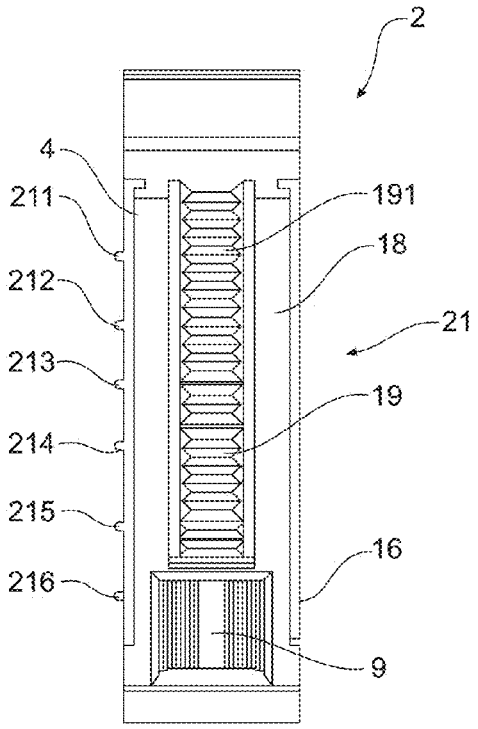
FIG. 31 is a side view of the base of FIG. 29.
Figure 32:
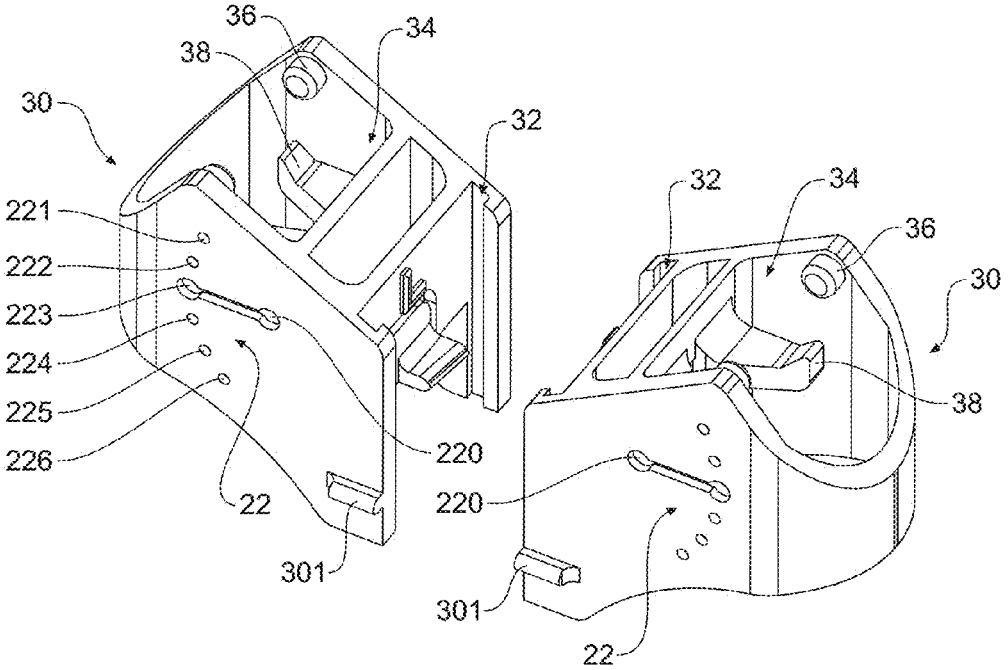
FIG. 32 is a perspective view of a pair of carriages (comprising a left hand side carriage, and a right hand side carriage) from the device of FIG. 28.
Figure 33:
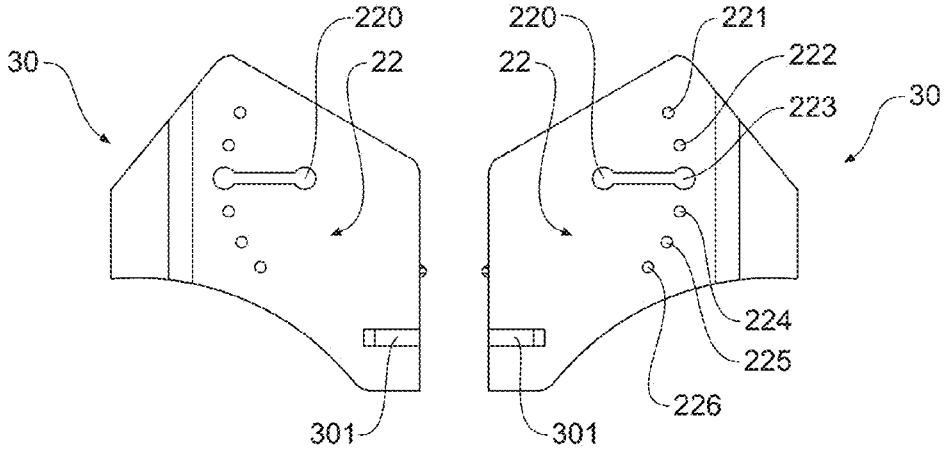
FIG. 33 is a front view of the carriages of FIG. 32.
Figure 34:
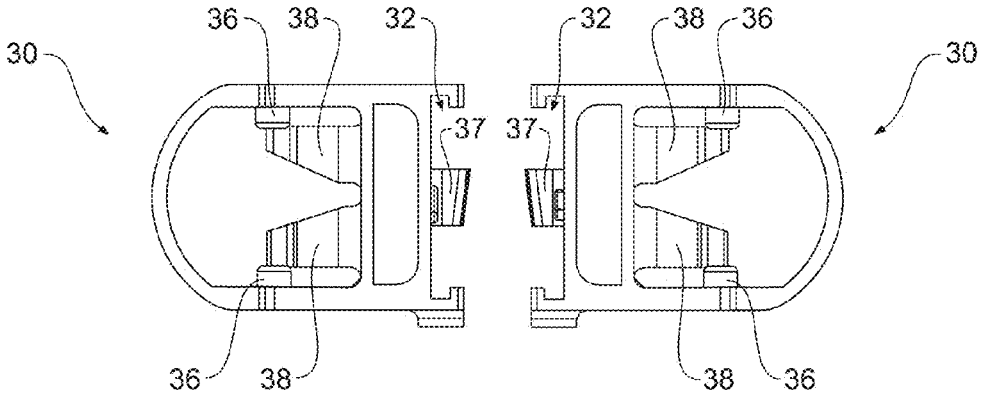
FIG. 34 is a plan view of the carriages of FIG. 32.

Further adjustment can be achieved by moving the device 1 along the barrel(s) 102 of the firearm 100 as shown in FIGS. 26 and 27. More particularly, by increasing the distance of the device 1 from the muzzle M, greater amounts of lead can be applied. In some embodiments, the device is placed between about 300 mm and about 1300 mm from the eye of the shooter, for example, approximately 700 mm.

With reference to FIG. 22, it can be seen that the device 1 has been set for the maximum lead on a crossing target. This setting would provide 2.5 m lead at 30 m. The wing 50 has been fully extended to the right (i.e. the pointer 232 aligns with graduation 615 to place the compensating bead 60 mm from the centre of the gun sight), the carriage 30 is set to marking 213 and the wing mount 40 is set to marking 223 which provide a level or horizontal shooting plane.

This target presentation is a difficult one for a beginning shooter, because the beginning shooter is being asked to shoot so far in front of the target T. Coaches often find themselves instructing the beginning shooter to, "miss in front and follow through on the trajectory of the target". The device 1 provides a visual cue or guide for the shooter to do this.

By adjusting the wing 50 the compensating bead 54 can be moved closer to the barrel 102 of the firearm, which will produce a setting for a quartering target or a target that is slower and or closer. In these situations less lead is required and the device 1 is able to be adjusted to provide the shooter with a visual cue to the amount of lead required, no matter what the target T trajectory or speed.

Figure 23:
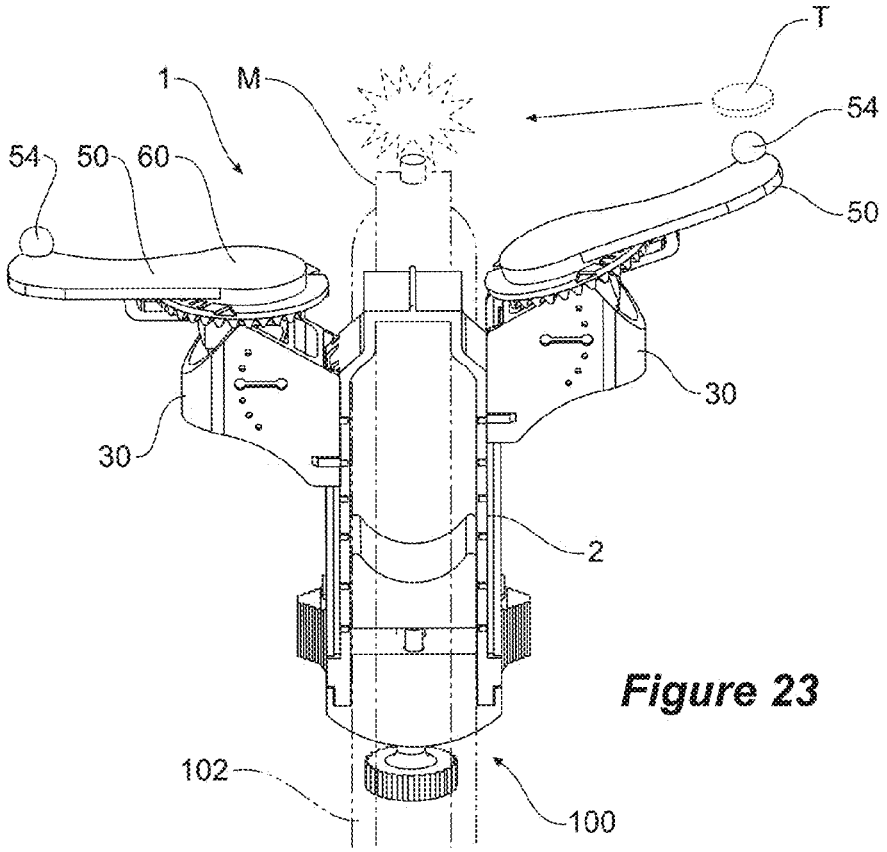

In FIG. 23, the device 1 is set to provide lead to a falling and crossing target T, again the instruction to the shooter is to place the target T above the compensating bead 54 and while moving the firearm 100 pull the trigger and then follow through on the trajectory of the target T. By doing this the shooter will be applying a 'collapsing lead' where the target 'collapses' or falls down toward the muzzle of the firearm 100. The device is set with the wing fully extended to the right (i.e. the pointer 232 aligns with graduation 615 to place the compensating bead 60 mm from the centre of the gun sight), the carriage 30 is set to marking 212 and the wing mount 40 is set to marking 222, which provide for a crossing target and a 15 degree fall.

Figure 24:
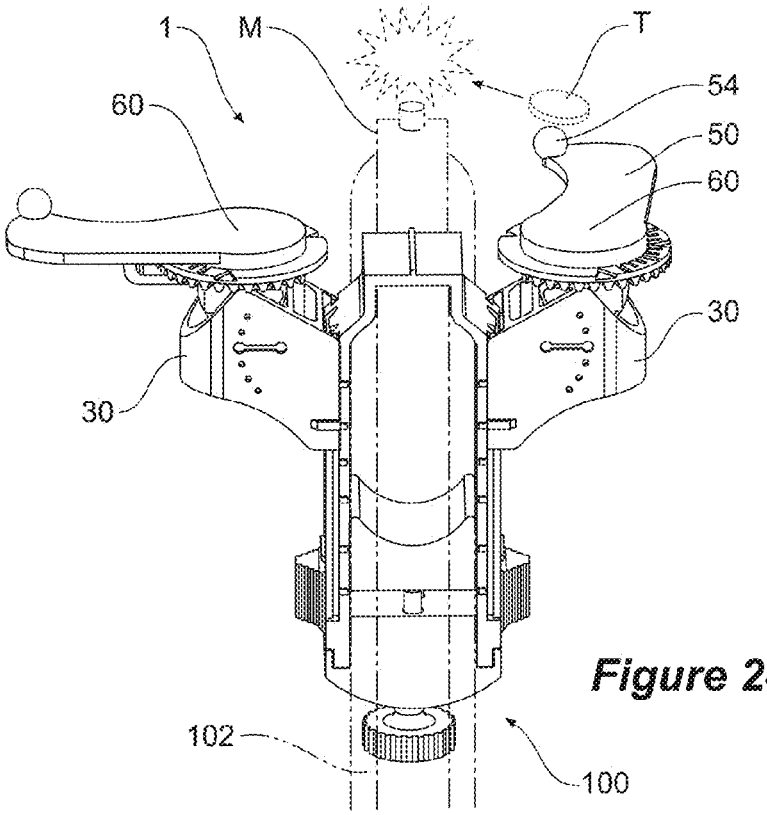

In FIG. 24, the device has been set to indicate the lead necessary in the case of a target T that is only just moving and commencing to fall, such as a chondel or high incoming target. Very little lead is necessary as the target T is stalling in the vertical plane and only just starting to fall but still has some (in this case) right to left movement. This target T can be at long range (over 40 m) which often induces in the shooter the strong inclination to see a bigger lead than is really needed. This presentation is often 'over shot', i.e. given much too much lead. The instruction to the shooter is to 'shoot just under and just to the left of the target'. This is achieved by setting the device with the wing close to the barrel (i.e. the pointer 232 aligns around graduation 611 or 612 to place the compensating bead approximately 12 to 24 mm from the centre of the gun sight) the carriage 30 is set to marking 212 (alternatively marking 213) and the wing mount is set to marking 222 (alternatively marking 223).

Figure 25:
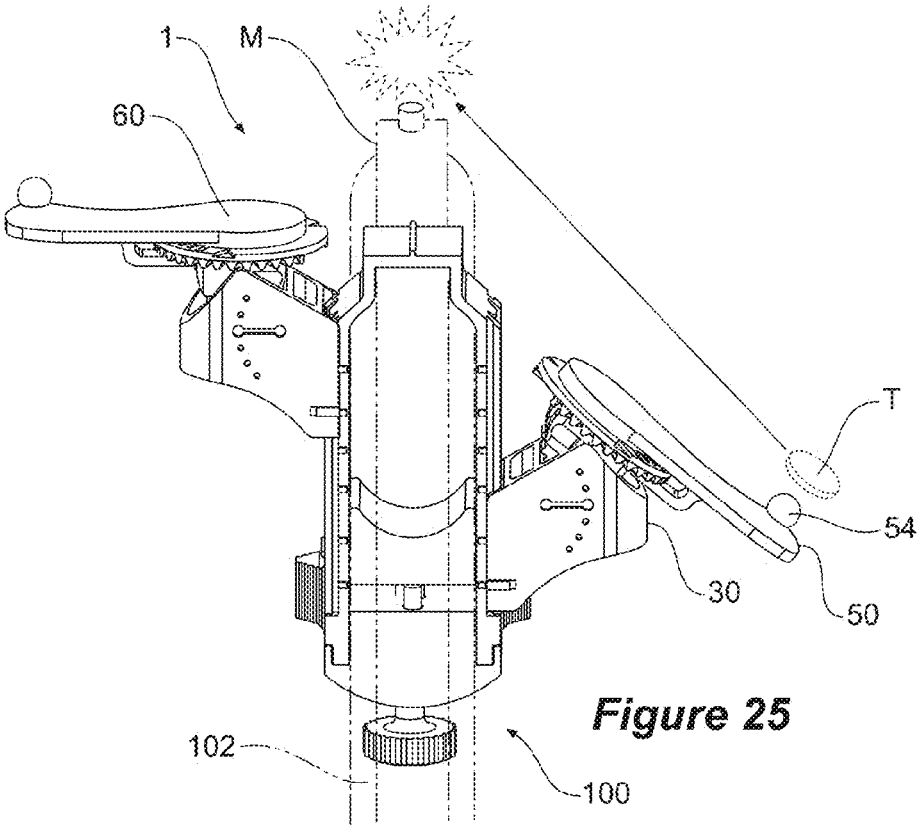

In FIG. 25, the target T presented is climbing and quartering slightly right to left (quartering springer). The shooter needs to shoot above and to the left of the target T. The coach has set the carriage 30 at its lowest setting (i.e. marking 216), has rotated the wing mount 40 downwards (i.e. marking 226) and the wing is set so that the pointer 244 aligns around graduation 813, to produce an extreme setting that will place the shot above and to the left of the target T. Again the instruction to the shooter will be to place the target T above the compensating bead 54, pull the trigger and follow through on the trajectory of the target. At any given distance/target speed combination, the correct lead can be established by moving the firearm 100 so that the target T can be seen above the compensating bead 54 and then firing and following through on the trajectory of the target T, thus keeping the target T above compensating bead 54 until the target T is hit.

A shooter who is unsure of the amount of lead that should be applied to a given target T can experiment with the device 1 until they find the correct lead. The shooter can make a first estimate of lead and adjust the wing 50 to provide that lead. If the target is missed, then the shooter can increase or decrease the lead by adjusting the wing 50. Without the device 1, the shooter in this situation can only guess about how much more or less lead they are actually applying. The device 1 allows them to see whether or not they are actually applying more or less lead as it provides them with a constant point of reference. Once the shooter is able to consistently hit the target, the device 1 can be removed.

A shooting coach can employ the device 1 to instruct a student. Before going onto the range the coach is able to set various 'lead pictures' for the student. Once the device 1 is fitted to the students firearm and the 'lead picture' is set, the coach can use a laser pointer to simulate a moving target and have the student execute their shooting movement; in so doing the student is able to see a simulated lead that enables them to become aware of just how far in front of a target T they need to be to break it. This cuts down the time and cost of acquiring the knowledge necessary to break a moving target T.

When shooting in the field, the coach can fit the device 1 to the shooter's firearm 100 and adjust the wing 50 and carriage 30 to provide a lead picture for the student. This is particularly useful when the student is tackling a new type of target trajectory or if they 'lose' a sight picture and start to miss a target T they have previously been hitting. This greatly speeds up the coaching process.

It should be apparent from all of the above therefore, that the device 1 according to the present disclosure accelerates the process of training a shooter to lead a moving target T, reducing the cost associated with coaching time and ammunition, and reducing shooter frustration.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the disclosure is not restricted in its use to the particular application described. Neither is the present disclosure restricted in its preferred embodiment with regard to the particular elements and/or features described or depicted herein. It will be appreciated that the disclosure is not limited to the embodiment or embodiments disclosed, but is capable of numerous rearrangements, modifications and substitutions without departing from the scope of the disclosure as set forth and defined by the following claims.

The invention claimed is:

1. A device for aiding marksmanship, the device comprising:

a base securable to a firearm, a compensating sight spaced apart from the base to at least a side of the firearm and positionally adjustable with respect to the base, wherein in use, the compensating sight is so positioned with respect to the base that when the firearm is aimed at a moving target via the compensating sight an appropriate amount of lead is applied to the target;

wherein the compensating sight is a part of a compensating sight assembly that comprises the base, a carriage depending from the base, a wing mount depending from the carriage, a wing depending from the wing mount, and the compensating sight depending from the wing;

wherein the base comprises a normally extending track along which the carriage is positionable;

wherein the wing mount is pivotable with respect to the carriage, and about an axis parallel to a longitudinal axis of a barrel of the firearm; and wherein the wing is pivotable with respect to the wing mount, and about a normal axis that is perpendicular to the longitudinal axis of the barrel of the firearm.

2. The device of claim 1, wherein the base of the device is movable along, and securable with respect to, a barrel of the firearm.

3. The device of claim 1, wherein the base comprises a frame comprising an aperture for receiving a barrel of the firearm therethrough.

4. The device of claim 1, wherein the base comprises a clamping means for locking a position of the base with respect to the firearm.

5. The device of claim 1, wherein the compensating sight assembly comprises an adjustment means providing a lateral movement at least, of the compensating sight relative to a barrel of the firearm.

6. The device of claim 5, wherein the adjustment means further provides a longitudinal movement of the compensating sight relative to the barrel of the firearm.

7. The device of claim 1, wherein the compensating sight assembly comprises a further adjustment means providing a normal (or vertical) movement of the compensating sight relative to a barrel of the firearm.

8. The device of claim 1, wherein the compensating sight comprises a bead.

9. The device of claim 1, wherein the device comprises a compensating sight assembly to either side of the base.

10. A device for aiding marksmanship, the device comprising a base securable to a firearm, a compensating sight spaced apart from the base to at least a side of the firearm and positionally adjustable with respect to the base, wherein in use, the compensating sight is so positioned with respect to the base that when the firearm is aimed at a moving target via the compensating sight an appropriate amount of lead is applied to the target;

wherein the compensating sight is a part of a compensating sight assembly;

wherein the compensating sight assembly comprises the base, a carriage depending from the base, a wing mount depending from the carriage, a wing depending from the wing mount, and the compensating sight depending from the wing;

wherein the wing mount is pivotable with respect to the carriage, and about an axis parallel to a longitudinal axis of a barrel of the firearm; and wherein the wing is pivotable with respect to the wing mount, and about a normal axis that is perpendicular to the longitudinal axis of the barrel of the firearm.

* * * * *